US010254054B2

(12) United States Patent
Jin et al.

(10) Patent No.: US 10,254,054 B2
(45) Date of Patent: Apr. 9, 2019

(54) INTEGRAL SEALING DEVICE AND HEAT EXCHANGER USING SAME

(71) Applicant: Danfoss Micro Channel Heat Exchanger (Jiaxing) Co., Ltd., Zhejiang (CN)

(72) Inventors: Junfeng Jin, Zhejiang (CN); Jing Yang, Zhejiang (CN); Yandong Tang, Zhejiang (CN); Huan Jin, Zhejiang (CN)

(73) Assignee: DANFOSS MICRO CHANNEL HEAT EXCHANGER (JIAXING) CO., LTD., Zhejiang (CN)

( * ) Notice: Subject to any disclaimer, the term of this patent is extended or adjusted under 35 U.S.C. 154(b) by 211 days.

(21) Appl. No.: 15/121,227

(22) PCT Filed: May 8, 2015

(86) PCT No.: PCT/CN2015/078528
§ 371 (c)(1),
(2) Date: Aug. 24, 2016

(87) PCT Pub. No.: WO2015/169250
PCT Pub. Date: Nov. 12, 2015

(65) Prior Publication Data

US 2017/0010055 A1 Jan. 12, 2017

(30) Foreign Application Priority Data

May 9, 2014 (CN) ..... 2014 2 0238387 U

(51) Int. Cl.

| | |
|---|---|
| ***F28F 9/02*** | (2006.01) |
| ***F28F 9/18*** | (2006.01) |
| ***F28D 1/053*** | (2006.01) |

(52) U.S. Cl.
CPC ..... *F28F 9/0219* (2013.01); *F28D 1/05375* (2013.01); *F28F 9/0214* (2013.01);
(Continued)

(58) Field of Classification Search
CPC ..... F28F 9/0219; F28F 9/005; F28F 9/0243; F28F 9/0248; F28F 9/165; F28F 9/185;
(Continued)

(56) References Cited

U.S. PATENT DOCUMENTS 3,041,571 A * 6/1962 Friend ..... H05K 7/12 362/396
3,314,499 A * 4/1967 Blackman ..... A61B 7/02 181/131

(Continued)

FOREIGN PATENT DOCUMENTS

| | | | | |
|---|---|---|---|---|
| CN | 1710367 A | 12/2005 | | |
| CN | 203811017 U | 9/2014 | | |
| EP | 1 657 513 A1 | 5/2006 | | |
| GB | 398414 A * | 9/1933 | ..... | F22G 3/007 |

OTHER PUBLICATIONS

International Search Report for PCT Serial. No. PCT/CN2015/078528 dated Jul. 17, 2015.

*Primary Examiner* — Frantz F Jules
*Assistant Examiner* — Jose O Class-Quinones
(74) *Attorney, Agent, or Firm* — McCormick, Paulding & Huber LLP

(57) ABSTRACT

A heat exchanger and an integral sealing device (100, 200, 300, 400, 500) used for a manifold (10, 10') in the heat exchanger. The manifold (10, 10') on one side of the heat exchanger includes two pipelines (11, 12, 11', 12') which are parallel to each other and communicated with each other. A first bore (13) and a second bore (14) are formed in two pipelines (11, 12, 11', 12') due to a drilling process. The first bore (13) is used for enabling refrigerant to flow from a
(Continued)

cavity of one of two pipelines (11, 12, 11', 12') into a cavity of the other pipeline. The second bore (14) is a process hole left by the drilling process, and the integral sealing device (100, 200, 300, 400, 500) seals the process hole.

9 Claims, 12 Drawing Sheets

(52) U.S. Cl.
CPC ..... *F28F 9/0243* (2013.01); *F28F 9/18* (2013.01); *F28F 2230/00* (2013.01)

(58) Field of Classification Search
CPC .. F28F 9/187; F28F 11/02; F28F 11/04; F28F 11/06; F28F 2220/00; F28F 2230/00; F28F 2265/16; F28F 7/02; F28F 9/0214; F28D 1/0246; F28D 1/05308; F16L 55/11; F16L 55/128; F16L 55/105; F16L 55/124; G21C 13/06; G21C 13/067; Y10S 220/19
USPC ..... 285/901; 403/10, 155, 308; 138/89
See application file for complete search history.

(56) References Cited

U.S. PATENT DOCUMENTS 3,731,735 A * 5/1973 Ris ..... F28B 1/06 165/110
4,291,803 A * 9/1981 Perales ..... B65D 59/02 206/303
4,338,383 A * 7/1982 Jutte ..... H01M 2/1217 429/175
4,445,727 A * 5/1984 Funk ..... B23K 31/02 138/109
4,502,297 A * 3/1985 Winterer ..... F25B 39/02 165/168
5,005,721 A * 4/1991 Jordan ..... B01L 3/50853 220/23.4
6,155,339 A * 12/2000 Grapengater ..... F28F 9/02 165/144
6,176,303 B1 1/2001 Kobayashi
6,343,706 B1 * 2/2002 Andersson ..... F16L 57/005 138/89
2003/0221819 A1 12/2003 Jang
2011/0174472 A1 * 7/2011 Kurochkin ..... F28D 1/05391 165/174
2012/0267086 A1 * 10/2012 Yanik ..... F25B 39/00 165/174

* cited by examiner

INTEGRAL SEALING DEVICE AND HEAT EXCHANGER USING SAME

CROSS-REFERENCE TO RELATED APPLICATIONS

This application is entitled to the benefit of and incorporates by reference subject matter disclosed in the International Patent Application No. PCT/CN2015/078528 filed on May 8, 2015 and Chinese Patent Application 201420238387.X filed May 9, 2014.

TECHNICAL FIELD

The present invention relates to the fields of heating, ventilation and air conditioning, motor vehicles, cooling and transportation, and in particular relates to the sealing of heat exchangers such as micro-channel/parallel-flow evaporators and heat pumps, and to such heat exchangers.

BACKGROUND ART

As FIGS. 1*a*-1*c* show, in practical applications of extruded profiles in engineering, it is necessary to drill a first hole 1 and a second hole 2 using a drill bit. The first hole is a hole needed for coolant to flow from a first cavity 3 to a second cavity 4; the second hole 2 is a process hole left by the drill bit or ram, and must be sealed using a metal plug 5.

When a large number of first and second holes need to be provided, there will be a corresponding number of plugs 5 blocking the second holes 2, with the result that processing efficiency is low. Each plug exists independently, with no association between different plugs, so that one or more plugs can easily fall out during welding, thereby causing an entire manifold to leak.

In view of the above, there is definitely a need to provide a novel sealing structure capable of at least partially solving the problem above, or a heat exchanger using such a sealing structure.

SUMMARY

The object of the present invention is to resolve at least one aspect of the abovementioned problems and shortcomings in the prior art.

The present invention provides an integral sealing device for a manifold in a heat exchanger, wherein a manifold on one side of the heat exchanger comprises two pipelines which are parallel and in communication with each other, first drill holes and second drill holes are provided on the two pipelines due to a drilling process, wherein the first drill holes are used for causing a coolant to flow from a cavity of one of the two pipelines into a cavity of the other pipeline, the second drill holes are process holes left by a drilling process, and the integral sealing device seals the process holes.

Specifically, the integral sealing device comprises at least one continuous collar and at least one continuous plug which are arranged alternately and connected to each other.

Specifically, each continuous collar comprises at least one rib and at least one loop, with the loop being disposed at an end of the rib.

Specifically, the continuous plug comprises at least one plug part and a connecting part connected to the plug part.

Specifically, the continuous collar comprises two integrally formed loops and a connecting part connecting the two loops, or the continuous collar is formed by winding a cylindrical element to form a loop at both ends thereof; the continuous plug is a U-shaped plug and comprises two plug parts at two ends and a connecting part connecting the plug parts.

Specifically, the integral sealing device comprises a continuous collar, and multiple loops connected to each other by ribs are provided on the continuous collar or the continuous collar is formed by winding a cylindrical element to form multiple loops thereon.

Specifically, single plugs or plug parts of multiple continuous plugs pass through the loops to block the process holes, wherein the continuous plug is a U-shaped plug and comprises two plug parts at two ends and a connecting part connecting the plug parts.

Specifically, the integral sealing device comprises at least one integral blocking plate, the integral blocking plate being connected by welding to the outside or inside of the pipeline in order to seal the process holes.

Specifically, multiple protrusions for blocking the process holes are provided at intervals on a surface on one side of the integral blocking plate.

Specifically, the at least one integral blocking plate is multiple blocking plate sections, each blocking plate section being provided at the ends with a notch for fixing the blocking plate section to a manifold surface.

According to another aspect of the present invention, a heat exchanger is provided, comprising:

manifolds located on two opposite sides, wherein the manifold on one side comprises two pipelines which are parallel but not in direct communication with each other, the manifold on the other side comprises two pipelines which are parallel and in communication with each other, and multiple holes or slots are provided on the pipelines which are in communication with each other;

multiple flat tubes which connect pipelines in the manifolds with each other via the holes or slots;

wherein first drill holes and second drill holes are provided due to a drilling process on the two pipelines which are in communication with each other, wherein the first drill holes are used for causing a coolant to flow from a cavity of one of the two pipelines into a cavity of the other pipeline, and the second drill holes are process holes left by a drilling process, wherein an integral sealing device as described above seals the process holes by welding.

Specifically, multiple fins are provided on the flat tubes; multiple flow paths are provided in the flat tubes.

BRIEF DESCRIPTION OF THE DRAWINGS

These and/or other aspects and advantages of the present invention will become obvious and easy to understand through the following description of the preferred embodiments in conjunction with the accompanying drawings, wherein.

DETAILED DESCRIPTION

The technical solution of the present invention is explained in further detail below by means of embodiments in conjunction with FIGS. 2*a*-10. In this description, identical or similar drawing labels indicate identical or similar components. The following explanation of the embodiments of the present invention with reference to the accompanying drawings is intended to explain the overall inventive concept of the present invention, and should not be interpreted as a limitation of the present invention.

Figure 1A:
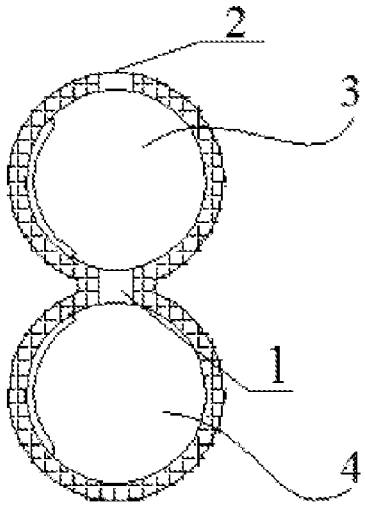
FIGS. 1*a*-1*c* are sectional drawings and an exploded view of pipelines in a manifold according to the prior art.
Figure 1B:
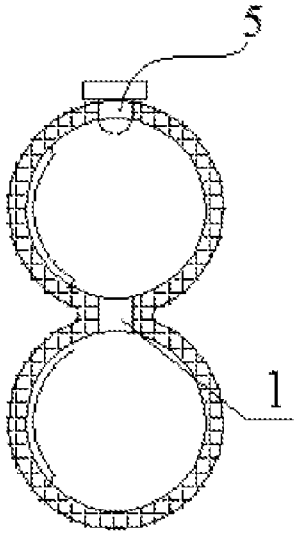
Figure 1C:
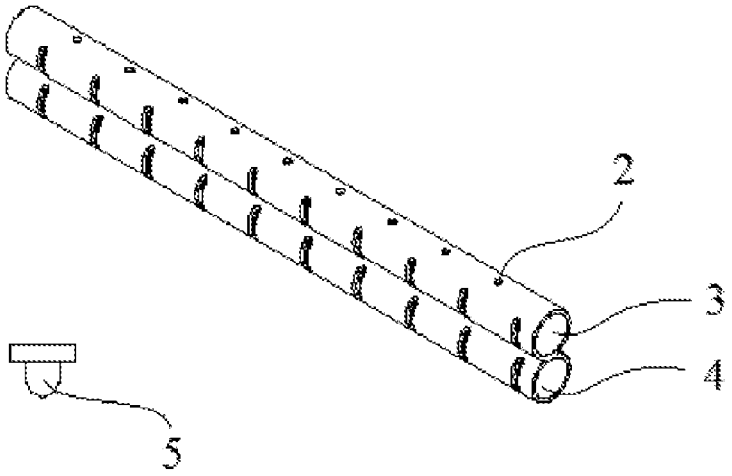
Figure 2A:
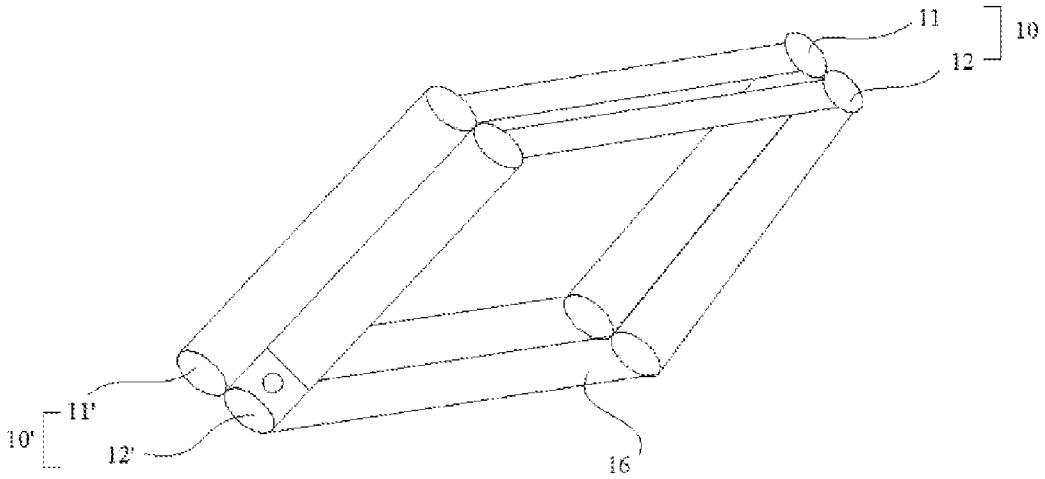
FIG. 2*a* is a view of a micro-channel heat exchanger according to the present invention.
Figure 2B:
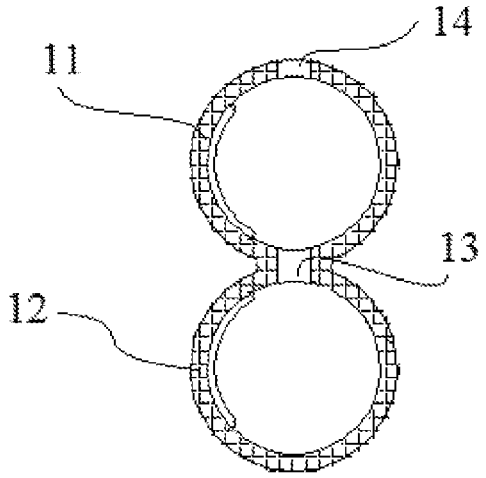
FIG. 2*b* is a sectional drawing of pipelines connected by a drilling process in the manifold shown in FIG. 2*a;*

FIGS. 2*a*-2*b* show a (micro-channel) heat exchanger according to an example of the present invention, the heat exchanger comprising a manifold, flat tubes 16 and fins (not shown). The manifold comprises a first manifold 10 and a second manifold 10' disposed on a side opposite thereto. The first manifold 10 comprises two parallel pipelines 11 and 12 in communication with each other, the second manifold 10' comprises two parallel pipelines 11' and 12' which are not in direct communication with each other (the meaning of "not in direct communication" used here is that the two pipelines 11' and 12' are not in direct communication with each other by hole or slot, but as shown in the figure, they are each in communication with the first manifold 10 via flat tubes; specifically, the pipelines 11' and 12' are each provided with an inlet and an outlet. The pipelines 11, 12, 11' and 12' are each provided with multiple holes or slots (not shown). Multiple flat tubes 15 connect pipelines in the manifolds with each other via the holes or slots, and multiple flow paths (not shown) are provided in the flat tubes 15, to allow the passage of fluid.

Specifically referring to FIG. 2*b*, the pipeline 11 and the pipeline 12 are connected side by side in a direction perpendicular to the longitudinal direction of the first manifold 10. Using a drill bit for example, holes are drilled in the pipelines 11 and 12 connected together, e.g. the first drill hole 13 and second drill hole 14 shown in the sectional view. The first drill hole 13 is used for connecting the pipelines 11 and 12 at a point of connection between the pipeline 11 and the pipeline 12, so that coolant (not shown) can flow from a cavity of the pipeline 11 into a cavity of the pipeline 12, or flow from the cavity of the pipeline 12 into the cavity of the pipeline 11. The second drill hole 14 is a process hole left by a drilling process, and is disposed on pipeline 11. In order to prevent leakage of the first manifold 10 during use, the second drill hole or process hole 14 is sealed by means of an integral sealing device.

Figure 3A:
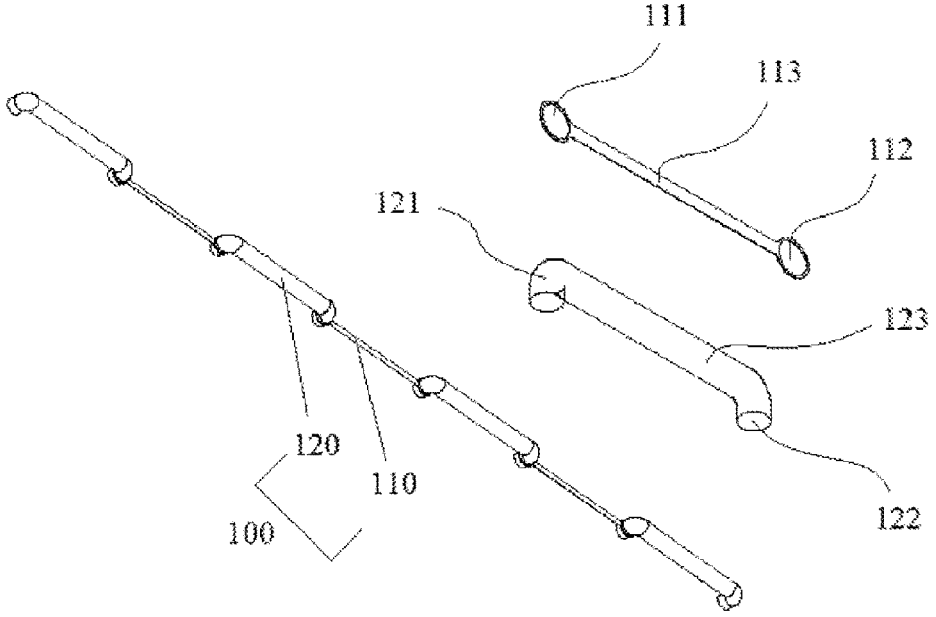
FIG. 3*a* is an exploded view of an integral sealing device according to a first embodiment of the present invention.
Figure 3B:
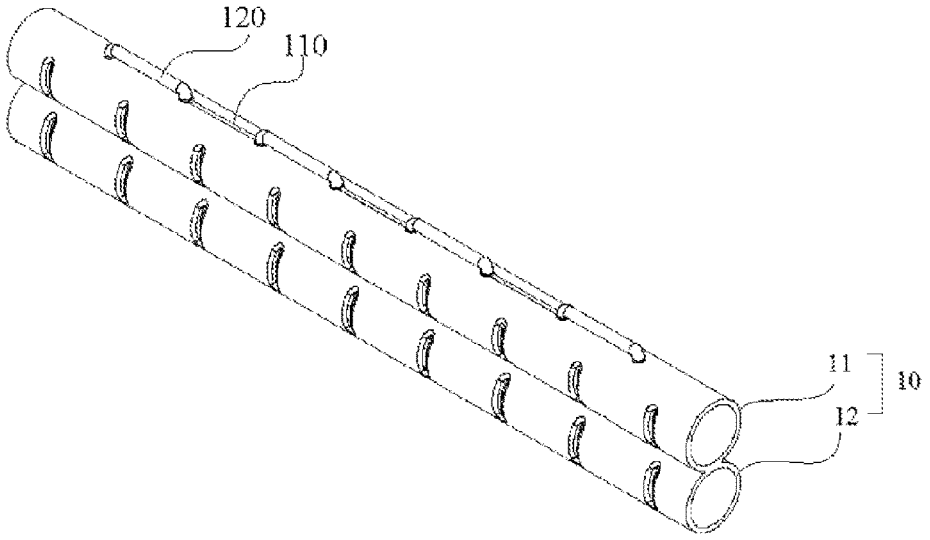
FIG. 3*b* is a view of the integral sealing device shown in FIG. 3*a*, fitted to a manifold.

Reference is made to FIGS. 3*a*-3*b*, which show an integral sealing device. The integral sealing device comprises at least one continuous collar and at least one continuous plug, the continuous collar and continuous plug being arranged alternately and connected to each other. Each continuous collar comprises at least one rib and at least one loop, with the loop being disposed at an end of the rib. The continuous plug comprises at least one plug part and a connecting part connected to the plug part.

In this example, the integral sealing device 100 comprises multiple continuous collars 110 and multiple continuous plugs 120. The number of continuous collars 110 and continuous plugs 120 matches the number of second drill holes 14 in the first manifold, so that all of the second drill holes 14 in the first manifold 10 can be sealed (of course, when necessary, it is also possible to partially seal the process holes 14 as required). For example, when there are three second drill holes 14, the integral sealing device 100 should comprise a matching number of plug parts, and so on.

The continuous collar 110 comprises two integrally formed loops 111 and 112 and a rib 113 connecting them. The continuous plug 120 is substantially U-shaped. The continuous plug 120 comprises two plug parts 121 and 122 and a connecting part 123. The plug parts 121 and 122 are disposed at two ends respectively of the continuous plug 120, i.e. at the two ends of the U-shape. The connecting part 123 is used for connecting the plug part 121 to the plug part 122, i.e. is a middle section of the U-shape. The length of the connecting part 123 is substantially equal to the separation of two adjacent second drill holes 14. Such an arrangement enables two adjacent continuous plugs 120 to be connected together, so that they will not easily fall off during use.

In this example, the plug parts 121 and 122 are designed to be cylindrical. Of course, those skilled in the art will understand that the shape of the plug part must match the shape of the second drill hole 14, i.e. when the second drill hole 14 is square, the plug part is correspondingly set to be square, etc.

During use, first of all the continuous collars 110 and continuous plugs 120 are connected together alternately by way of a mechanical connection (expansion joint) (i.e. are connected head to tail), thereby performing pre-assembly. In other words, a loop 111 in a continuous collar 110 is connected to a plug part 122 of a continuous plug 120, thereby forming an end of an entire integral sealing device; a loop 112 of the continuous collar is then connected to a plug part 121 of another continuous plug, while a plug part 122 is connected to a loop 111 of another continuous collar 110, and so on, until the number is sufficient to seal all the second drill holes 14 on the first manifold 10. Making connections in such a way can increase the installation efficiency and prevent single plugs from falling off. Next, the assembled integral sealing device is fitted onto the first manifold 10, such that the plug parts are respectively fitted into the second drill holes 14 in a one-to-one correspondence, for the purpose of sealing all of the second drill holes 14 on the manifold. Finally, the entire sealing device is fixed to the first manifold 10 by welding. In this example, the continuous collar may be made of a welding material, so that it may be used as a brazing material directly during welding.

Figure 4A:
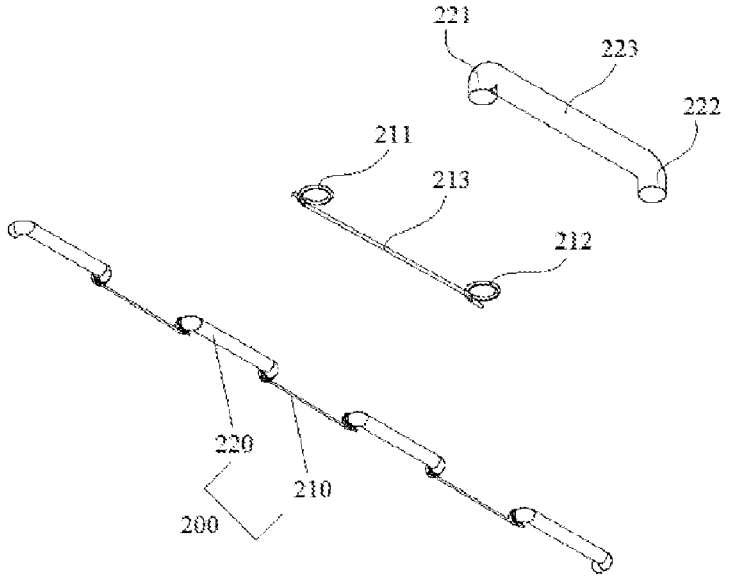
FIG. 4*a* is an exploded view of an integral sealing device according to a second embodiment of the present invention.
Figure 4B:
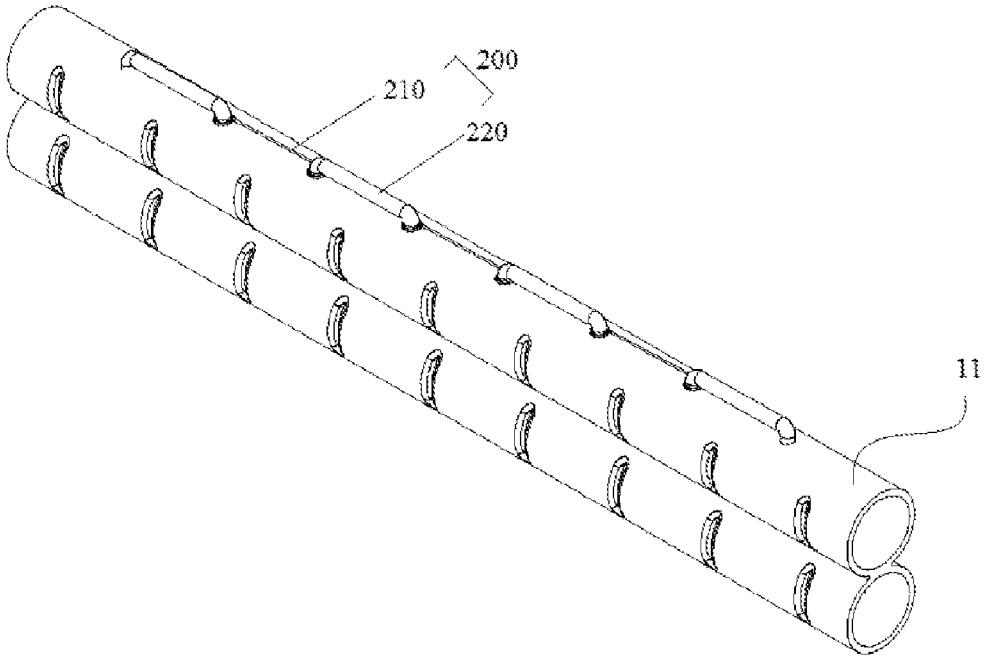
FIG. 4*b* is a view of the integral sealing device shown in FIG. 4*a*, fitted to a manifold.

Reference is made to FIGS. 4*a*-4*b*, which show an integral sealing device 200 according to a second embodiment of the present invention. The integral sealing device 200 is a variation of the integral sealing device 100 shown in FIG. 3*a*. Therefore, the structure and principles thereof are substantially the same as those of the integral sealing device shown in FIG. 2*a*, the difference being that the continuous collar is designed differently; the differences are described in detail below, but the identical features are not repeated here.

In this example, the integral sealing device 200 comprises multiple continuous collars 210 and multiple continuous plugs 220. Specifically referring to FIG. 4*a*, the continuous collar 210 is formed by winding a loop at both ends of a cylindrical element. That is, the continuous collar 210 is formed by winding a loop at both ends of a brazing material for example that is easily bent. During use, the two ends of the brazing material for example that is easily bent can first of all be wound to make loops 211 and 212 respectively; a connecting part 213 is naturally provided between the loops 211 and 212. Next, continuous plugs 220 and continuous collars 210 are connected head to tail, to form an integral sealing member; then the plug parts 221 and 222 (which are connected by a connecting part 223 as stated above) in the continuous plugs 220 are respectively put into second drill holes 14 in pipeline 11 of the first manifold; finally, the integral sealing device 200 is fixed to the first manifold 10 by welding.

The continuous plug 220 in this example is designed in the same way as the continuous plug 120 in the first embodiment, so is not described again here.

Figure 5A:
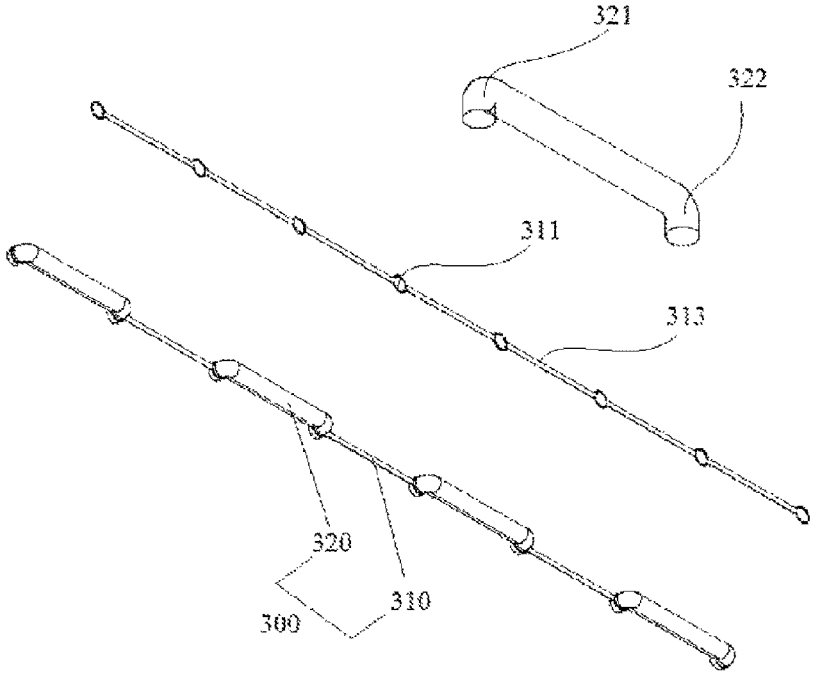
FIG. 5*a* is an exploded view of an integral sealing device according to a third embodiment of the present invention.
Figure 5B:
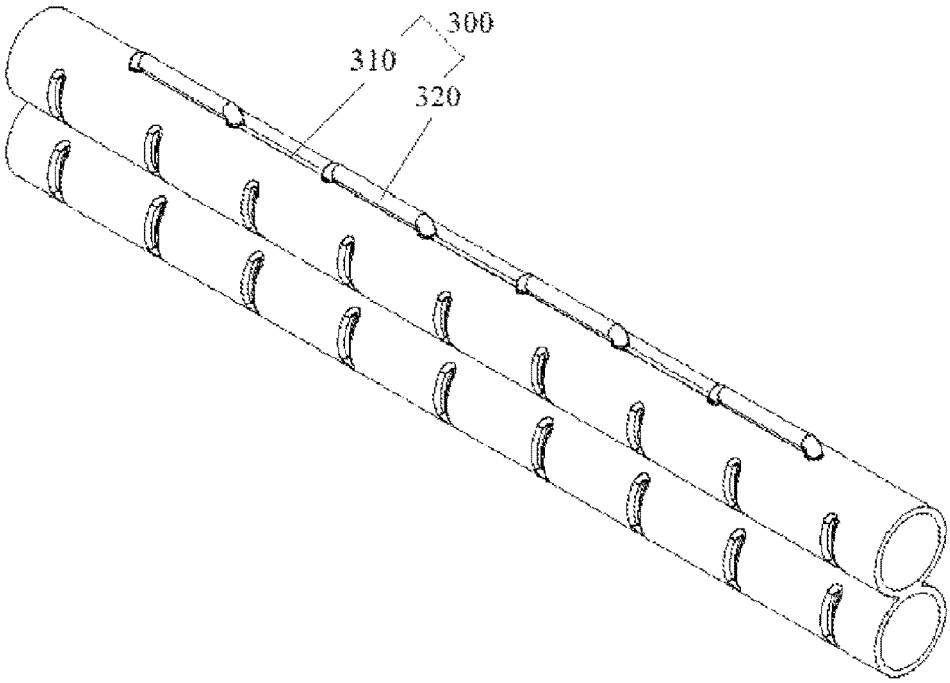
FIG. 5*b* is a view of the integral sealing device shown in FIG. 5*a*, fitted to a manifold.

Reference is made to FIGS. 5*a*-5*b*, which show an integral sealing device 300 fitted to a manifold according to a third embodiment of the present invention, and an exploded view thereof. The integral sealing device 300 is another variation of the integral sealing device 100 shown in FIG. 3*a*. Therefore, the structure and principles of the integral sealing device 300 are substantially the same as the structure and principles of the integral sealing device 100 shown in FIG. 3*a*, the difference being that the continuous collar 310 is designed differently; the differences are described in detail below, but the identical features are not repeated here.

In this example, the integral sealing device 300 comprises one continuous collar 310 and multiple continuous plugs 320. The continuous collar 310 is provided with multiple loops 311 connected together by means of ribs 313. As FIG. 5*a* shows, the loops 311 and the ribs 313 are connected together alternately and integrally formed. The length of the rib 313 is substantially equal to the separation of two adjacent loops 311.

During use, plug parts 321 and 322 of multiple continuous plugs 320 are respectively put into multiple loops 311 on a continuous collar 310, to form an integral sealing device 300; next, the assembled integral sealing device 300 is fitted onto the manifold 10, i.e. the plug parts 321 and 322 are respectively fitted into second drill holes 14 on the first manifold; finally, the integral sealing device 300 is fixed to the manifold by welding, to complete the sealing of the manifold.

In this example, the continuous plug 320 is designed in the same way as the continuous plug 120 in the first embodiment, so is not described again here.

Figure 6A:
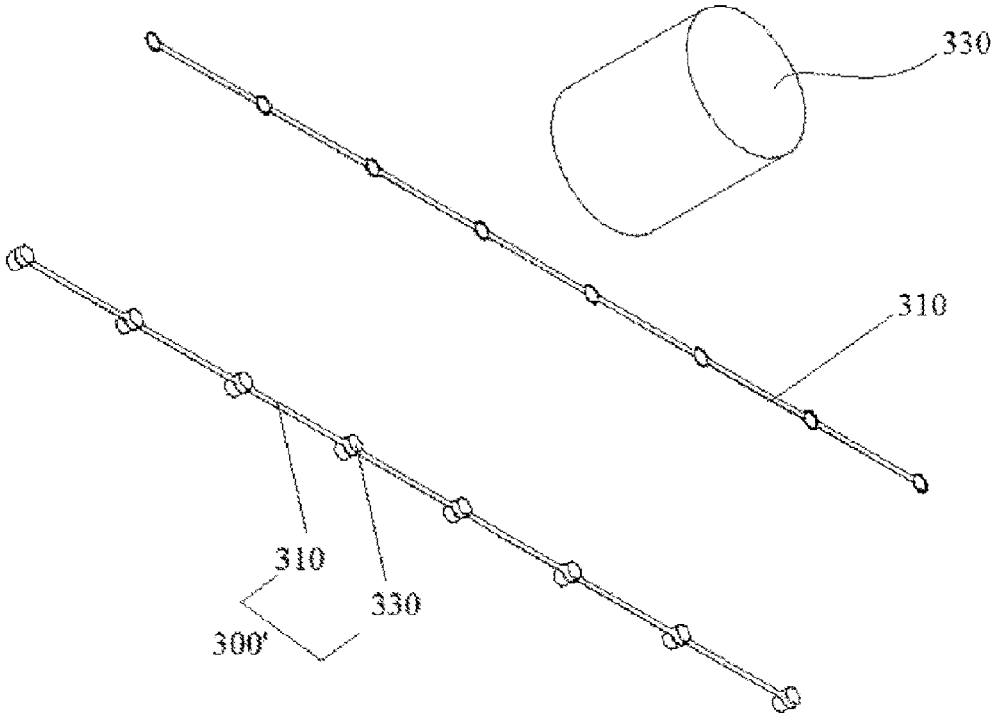
FIG. 6*a* is an exploded view of an integral sealing device according to a fourth embodiment of the present invention.
Figure 6B:
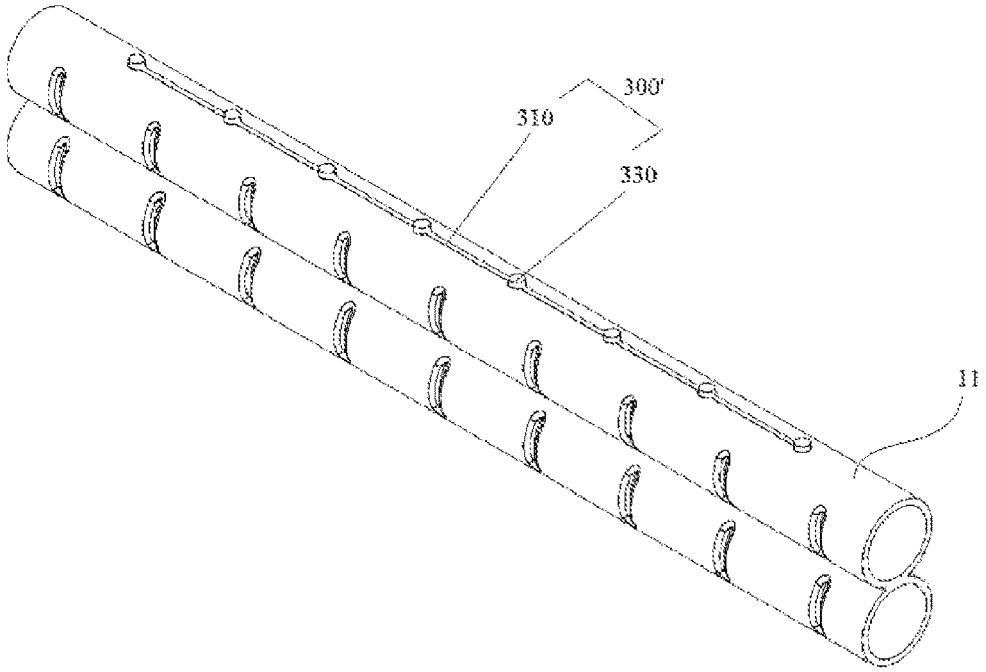
FIG. 6*b* is a view of the integral sealing device shown in FIG. 6*a*, fitted to a manifold.

Of course, those skilled in the art will understand that during use, single plugs may be used instead of continuous plugs. As FIGS. 6*a*-6*b* show, an integral sealing device 300' according to a fourth embodiment of the present invention comprises one continuous collar 310 and multiple plugs 330, with the number of single plugs 330 being equal to the number of second drill holes 14 in the pipeline 11 of the first manifold. In this example, the single plug 330 is designed to be cylindrical (as shown in the enlarged view at the top of FIG. 6*a*). Of course, those skilled in the art will understand that the shape of the plug 330 should match the shape of the second drill hole 14; this is conducive to sealing of the second drill hole.

During use, multiple plugs 330 are respectively fitted into loops 311 of a continuous collar 310 (as shown in FIG. 5*a*), to form the integral sealing device 300'; then the multiple plugs 300 in the assembled integral sealing device 300' are respectively fitted into second drill holes 14 of the pipeline 11 of the first manifold in a one-to-one correspondence, to achieve sealing thereof. Finally, the integral sealing device 300' is welded to the manifold (as shown in FIG. 6*b*).

Figure 7A:
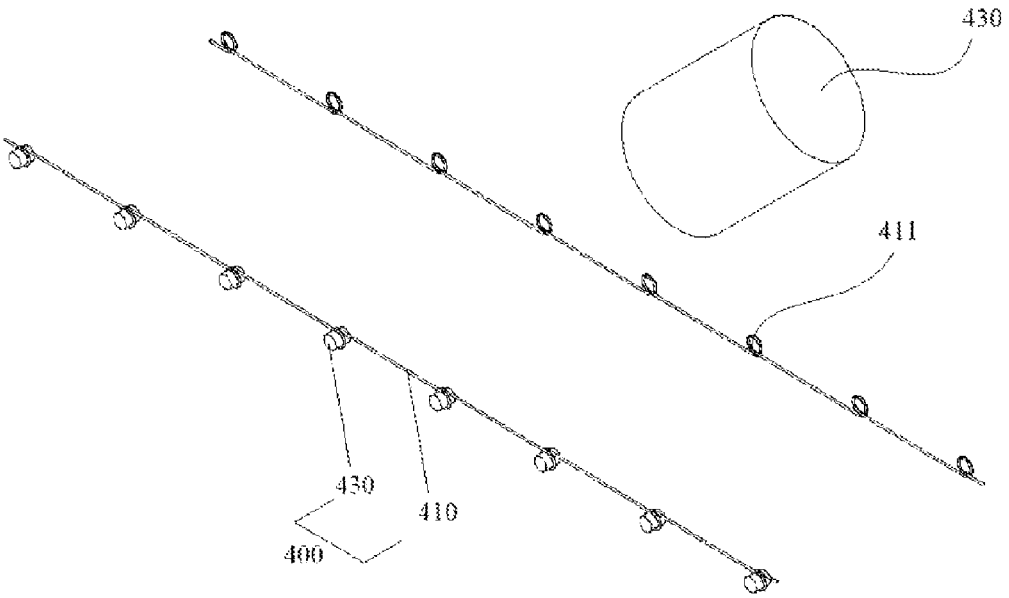
FIG. 7*a* is an exploded view of an integral sealing device according to a fifth embodiment of the present invention.
Figure 7B:
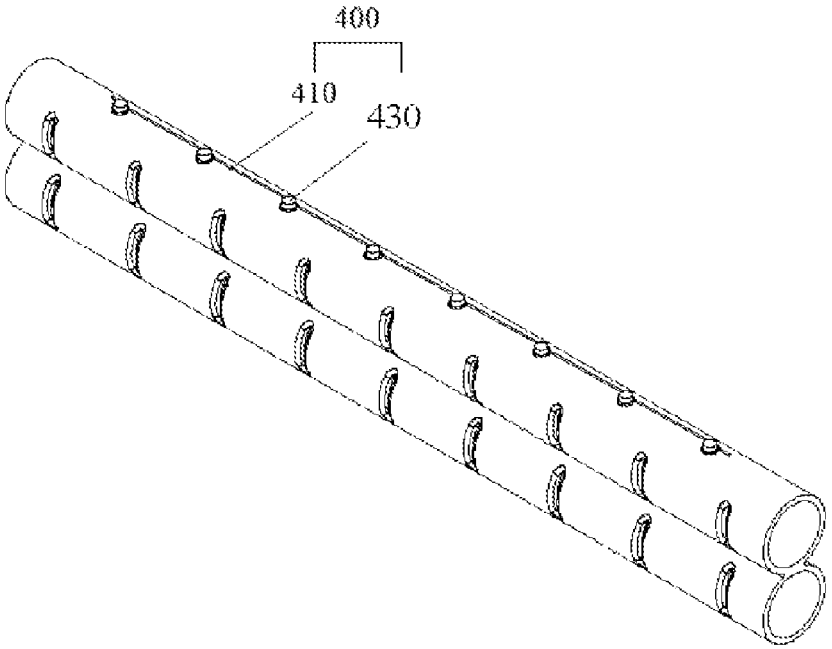
FIG. 7*b* is a view of the integral sealing device shown in FIG. 7*a*, fitted to a manifold.

Reference is made to FIGS. 7*a*-7*b*, which show an assembly view of an integral sealing device 400 fitted to a manifold according to a fifth embodiment of the present invention, and an exploded view thereof. The integral sealing device 400 is a variation of the integral sealing device 300' shown in FIG. 6*a*. Therefore, the structure and principles of the integral sealing device 400 are substantially the same as the structure and principles of the integral sealing device 300' shown in FIG. 6*a*, the difference being that the continuous collar is designed differently. The differences are described in detail below, but the identical features are not repeated here.

In this example, the integral sealing device 400 comprises one continuous collar 410 and multiple plugs 430. Specifically referring to FIG. 7*a*, the continuous collar 410 is formed by winding a cylindrical element to form multiple loops thereon. That is, the continuous collar 410 is formed by winding multiple loops 411 in a brazing material for example that is easily bent, with the distance between two adjacent loops 411 being substantially equal to the separation of two adjacent second drill holes 14 on the first manifold 10. The plug 430 is designed in the same way as the plug 330 described above, so is not described again here.

Figure 7C:
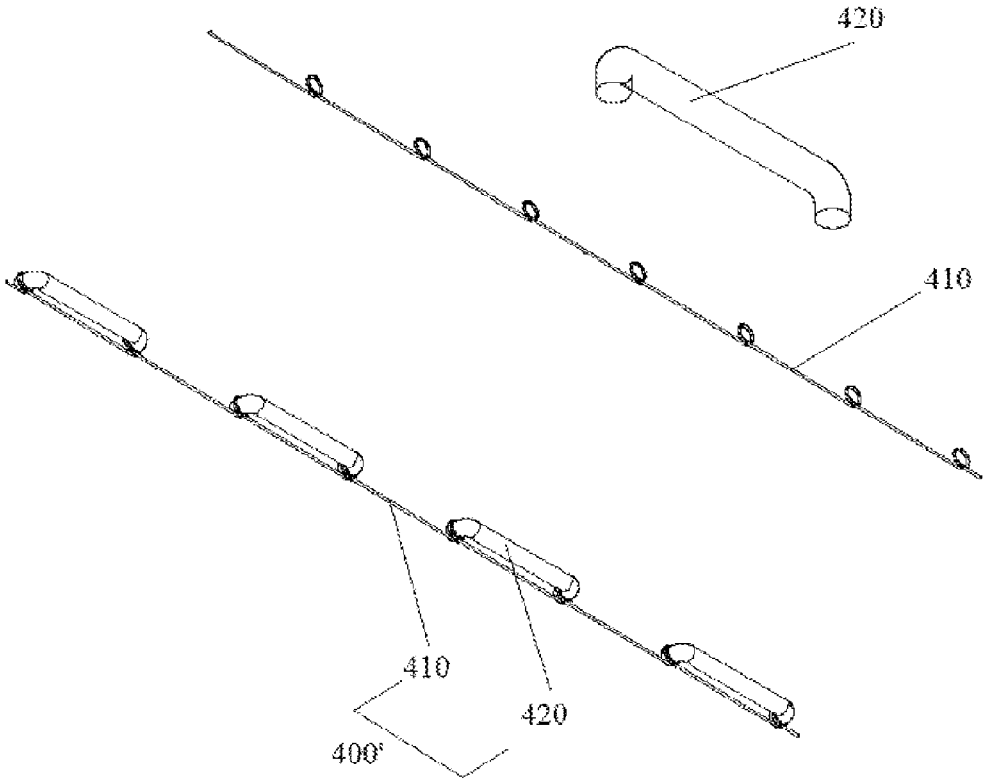
FIG. 7*c* is a variation of the integral sealing device of FIG. 7*a;*

Of course, those skilled in the art will understand that in this example, the plugs 430 may be replaced by a continuous plug 420. As FIG. 7*c* shows, the integral sealing device 400' comprises one continuous collar 410 and multiple continuous plugs 420. The continuous plug 420 is designed in the same way as the continuous plug 320 as shown in FIG. 5*a*, and the principles of the integral sealing device 400' are the same as the principles of the integral sealing device shown in FIG. 5*a*, so the descriptions are not repeated here.

Figure 8A:
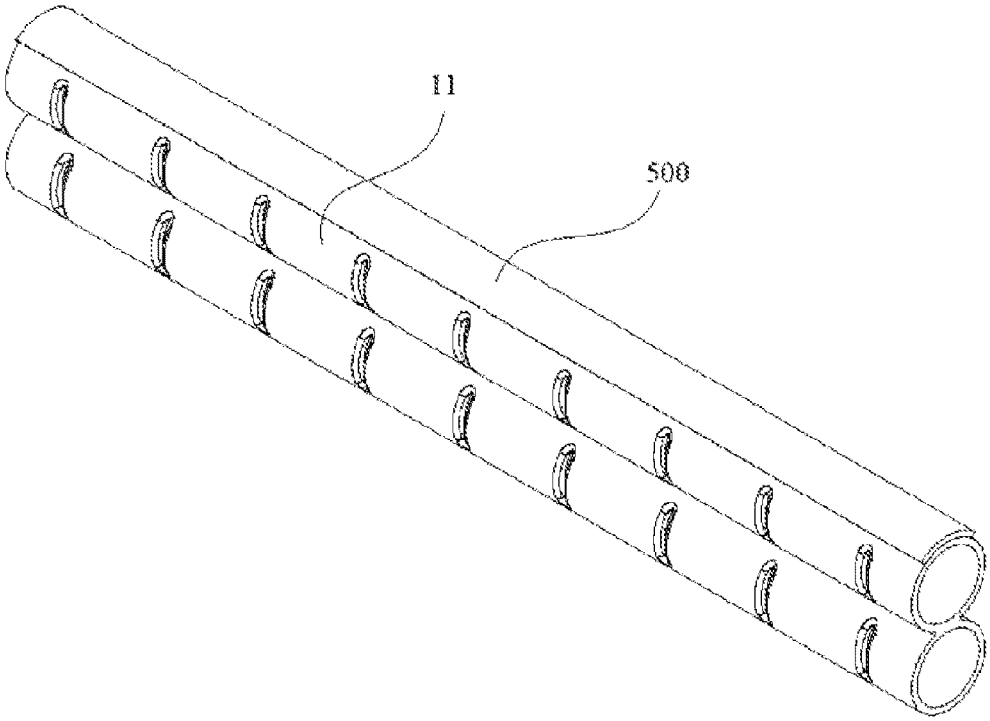
FIG. 8*a* is an exploded view of an integral sealing device according to a sixth embodiment of the present invention.
Figure 8B:
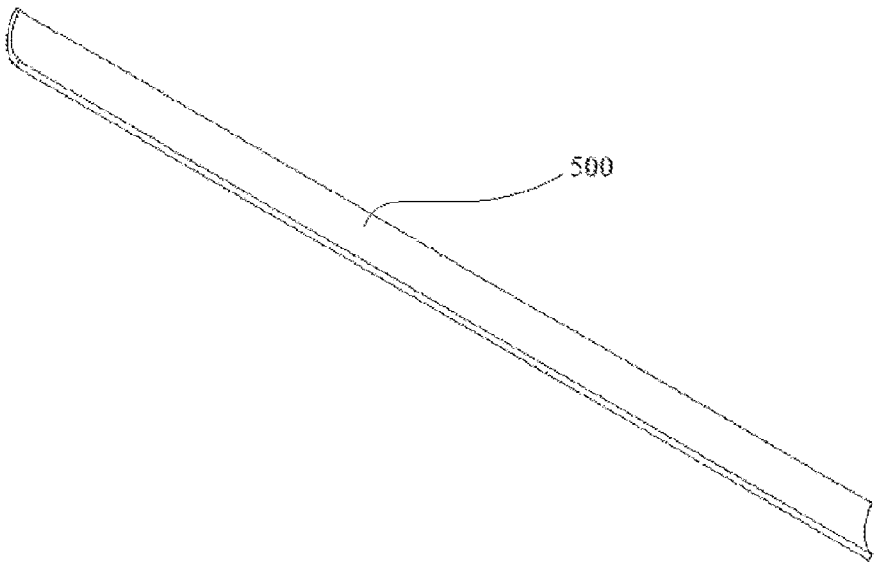
FIG. 8*b* is a view of the integral sealing device shown in FIG. 8*a*, fitted to a manifold.

Reference is made to FIGS. 8*a*-8*b*, which show an integral sealing device 500 fitted to a manifold according to a sixth embodiment of the present invention. Specifically referring to FIG. 8*b*, in this example, the integral sealing device 500 is an integral blocking plate. Of course, those skilled in the art may design the integral sealing device to be formed of multiple blocking plates as required. The integral blocking plate is substantially arcuate, and fits the shape of the pipeline 11 of the first manifold.

Figure 8C:
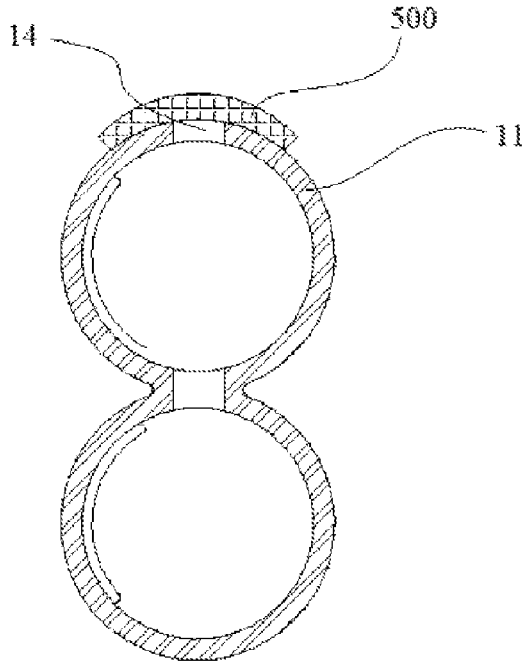
FIGS. 8*c* and 8*d* are sectional drawings of an integral sealing device fitted to an outer surface and an inner surface of a manifold, respectively.
Figure 8D:
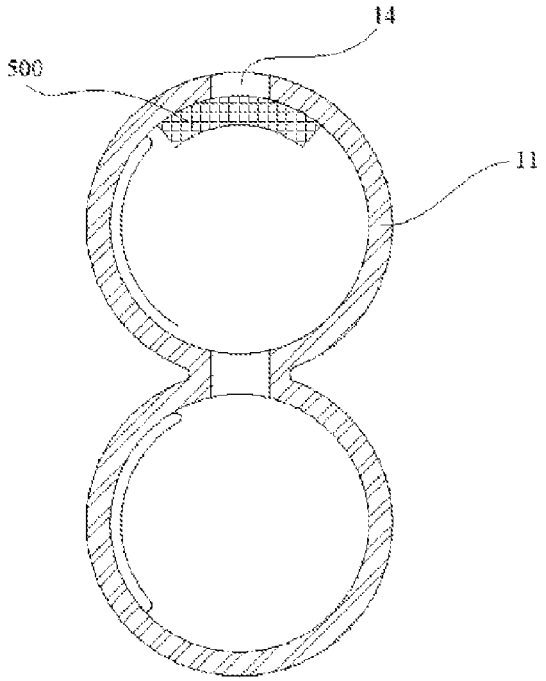

As FIG. 8*c* shows, the integral sealing device 500 is connected to the outside of the pipeline 11 by welding, in order to seal the process holes 14. Of course, those skilled in the art could connect the integral sealing device to the inside of the pipeline 11 by welding as required (as shown in FIG. 8*d*).

Figure 9A:
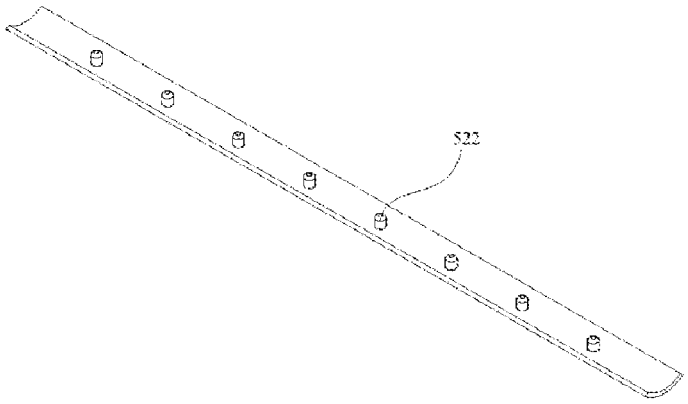
FIG. 9*a* is a variation of the integral sealing device of FIG. 8*a;*
Figure 9C:
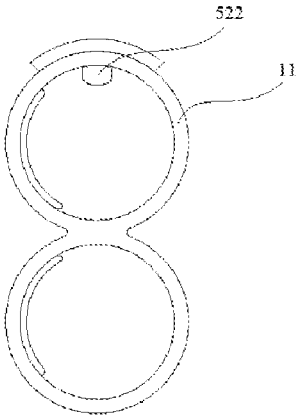
FIGS. 9*b* and 9*c* are an assembly and a sectional view respectively of the integral sealing device shown in FIG. 9*a*, fitted to a manifold.
Figure 9B:
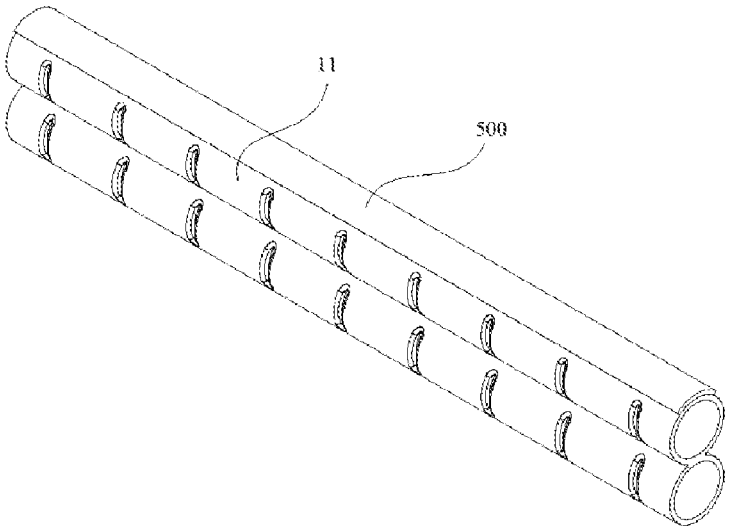

In this embodiment, to improve sealing, as shown in FIG. 9*a*, it is also possible for multiple protrusions 522 for blocking the process holes 14 to be provided at intervals on a surface on one side of the integral blocking plate. The protrusions 522 are disposed on that side which fits and is connected to the surface of the first manifold; this is conducive to sealing of the process holes 14 on the first manifold. During use, as FIGS. 9*b* and 9*c* show, the protrusions 522 are fitted into process holes in the pipeline 11 of the first manifold in a one-to-one correspondence, and when assembly is complete, the protrusions are fixed to the pipeline 11 by welding, to complete the sealing of the first manifold.

Figure 10:
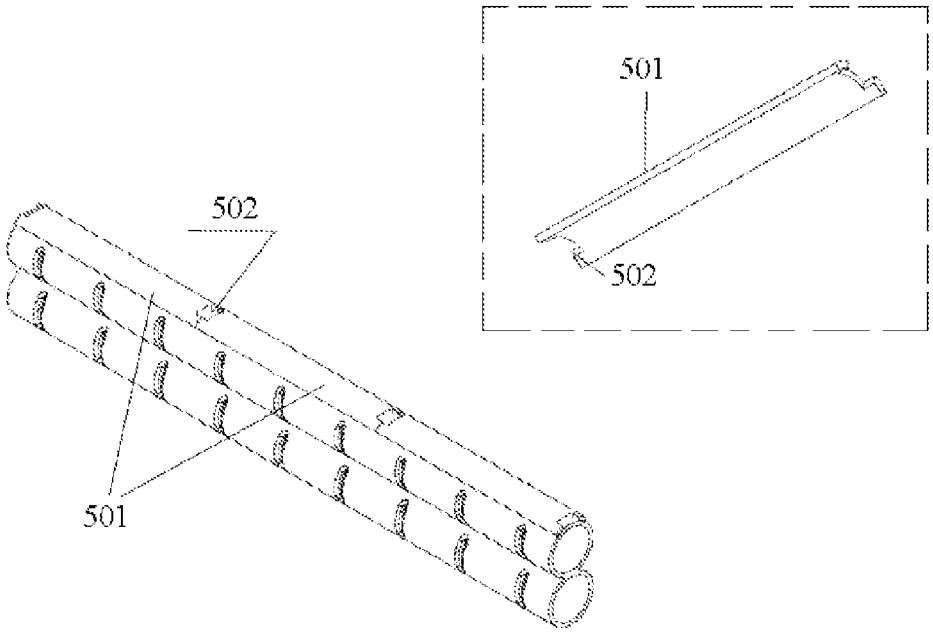
FIG. 10 is a view of an integral sealing device comprising multiple integral blocking plate sections.

In addition, the integral blocking plate of the present invention may also comprise multiple integral blocking plate sections 501, see FIG. 10. Each blocking plate section 501 is provided at the ends with a notch 502 for fixing the blocking plate section to the manifold surface. The notch is used for argon arc spot welding before furnace brazing; the integral blocking plate is fixed in a desired position on the manifold by argon arc spot welding. It can be understood that a protrusion 522 as described above may be provided on each blocking plate section.

The advantage of the present invention is that the integral blocking plate or integral plug structure of this design, and the design of other integral sealing devices, are such that single plugs or multiple plug structures are associated with each other, so that the processing efficiency is significantly improved, and leakage due to a single plug falling off is avoided.

The above are merely some embodiments of the present invention. Those skilled in the art will understand that changes may be made to these embodiments without departing from the principles and spirit of the overall inventive concept. The scope of the present invention is defined by the claims and their equivalents.

What is claimed is:

1. An integral sealing device for a manifold in a heat exchanger, wherein a manifold on one side of the heat exchanger comprises two pipelines which are parallel and in communication with each other, first drill holes and second drill holes are provided on the two pipelines due to a drilling process, wherein the first drill holes are used for causing a coolant to flow from a cavity of one of the two pipelines into a cavity of the other pipeline, the second drill holes are process holes left by a drilling process, and the integral sealing device seals the process holes, the integral sealing device comprises at least one collar and at least one plug connected to each other, wherein the at least one collar includes at least one loop that fully encloses an opening, wherein the at least one collar is continuous and the at least one plug is continuous which are arranged alternately, and wherein the continuous collar comprises two integrally formed loops of the at least one loop and a connecting part connecting the two loops, or the continuous collar is formed by winding a cylindrical element to form a loop of the at least one loop at both ends thereof; the continuous plug is a U-shaped plug and comprises two plug parts at two ends and a connecting part connecting the plug parts.

2. The integral sealing device as claimed in claim 1, wherein:

the connecting part is a rib, with one loop of the two integrally formed loops being disposed at each end of the rib.

3. The integral sealing device as claimed in claim 1, wherein:

the integral sealing device comprises a continuous collar, and multiple loops connected to each other by ribs are provided on the continuous collar or the continuous collar is formed by winding a cylindrical element to form multiple loops thereon.

4. The integral sealing device as claimed in claim 3, wherein:

plug parts of multiple continuous plugs pass through the loops to block the process holes.

5. A heat exchanger, comprising:

manifolds located on two opposite sides, wherein the manifold on one side comprises two pipelines which are parallel but not in direct communication with each other, the manifold on the other side comprises two pipelines which are parallel and in communication with each other, and multiple holes or slots are provided on the pipelines which are in communication with each other;

multiple flat tubes which connect pipelines in the manifolds with each other via the holes or slots;

wherein first drill holes and second drill holes are provided due to a drilling process on the two pipelines which are in communication with each other, wherein the first drill holes are used for causing a coolant to flow from a cavity of one of the two pipelines into a cavity of the other pipeline, and the second drill holes are process holes left by a drilling process, wherein an integral sealing device as claimed in claim 1 seals the process holes by welding.

6. The heat exchanger as claimed in claim 5, wherein:

multiple fins are provided on the flat tubes; multiple flow paths are provided in the flat tubes.

7. An integral sealing device for a manifold in a heat exchanger, wherein a manifold on one side of the heat exchanger comprises two pipelines which are parallel and in communication with each other, first drill holes and second drill holes are provided on the two pipelines due to a drilling process, wherein the first drill holes are used for causing a coolant to flow from a cavity of one of the two pipelines into a cavity of the other pipeline, the second drill holes are process holes left by a drilling process, and the integral sealing device seals the process holes, the integral sealing device comprises at least one collar and at least one plug, wherein the at least one plug seals at least two of the process holes of the manifold.

8. A heat exchanger, comprising:

manifolds located on two opposite sides, wherein the manifold on one side comprises two pipelines which are parallel but not in direct communication with each other, the manifold on the other side comprises two pipelines which are parallel and in communication with each other, and multiple holes or slots are provided on the pipelines which are in communication with each other;

multiple flat tubes which connect pipelines in the manifolds with each other via the holes or slots;

wherein first drill holes and second drill holes are provided due to a drilling process on the two pipelines which are in communication with each other, wherein the first drill holes are used for causing a coolant to flow from a cavity of one of the two pipelines into a cavity of the other pipeline, and the second drill holes are process holes left by a drilling process;

wherein an integral sealing device seals the process holes by welding; and wherein the integral sealing device comprises at least one collar and at least one plug connected to each other, wherein the at least one collar includes at least one loop that fully encloses an opening.

9. The heat exchanger as claimed in claim 8, wherein: multiple fins are provided on the flat tubes; multiple flow paths are provided in the flat tubes.

* * * * *